US006540030B2

(12) United States Patent
Ohzeki et al.

(10) Patent No.: US 6,540,030 B2
(45) Date of Patent: Apr. 1, 2003

(54) METHOD FOR RECOVERING WASTE IN SANDY BEACH

(75) Inventors: Takashi Ohzeki, Saitama (JP); Yoshihiro Kimura, Saitama (JP); Yasuji Hashimoto, Saitama (JP); Yoshinobu Itani, Saitama (JP); Takashi Shinozaki, Saitama (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/969,650

(22) Filed: Oct. 4, 2001

(65) Prior Publication Data

US 2002/0040790 A1 Apr. 11, 2002

(30) Foreign Application Priority Data

Oct. 6, 2000 (JP) ..... 2000-308494

(51) Int. Cl.[7] ..... A01D 15/00
(52) U.S. Cl. ..... 171/1; 172/DIG. 2
(58) Field of Search ..... 171/1, 63, 2, 83, 171/84, 104, 105, 106, 107, 143, 140, 139; 172/DIG. 2

(56) References Cited

U.S. PATENT DOCUMENTS

| | | | | |
|---|---|---|---|---|
| 4,014,390 A | * | 3/1977 | Teixeira | 171/124 |
| 4,167,975 A | * | 9/1979 | Fahrenholz | 171/12 |
| 4,542,550 A | * | 9/1985 | Bennett et al. | 15/3 |
| 5,133,413 A | * | 7/1992 | Baxter | 171/63 |
| 6,094,847 A | * | 8/2000 | Gallenberg | 37/422 |

FOREIGN PATENT DOCUMENTS

| | | | |
|---|---|---|---|
| JP | 2-161003 | * | 6/1990 |
| JP | 2-261111 | * | 10/1990 |
| JP | A 3-138203 | | 6/1991 |
| JP | 11-229338 | * | 8/1999 |
| JP | 2000-144671 | * | 5/2000 |
| JP | 2001-254324 | * | 9/2001 |

* cited by examiner

*Primary Examiner*—Victor Batson
(74) *Attorney, Agent, or Firm*—Birch, Stewart, Kolasch & Birch, LLP

(57) ABSTRACT

Waste scattered on a sandy beach is recovered in a clean and efficient manner by using a beach cleaner of a simple structure. In a first waste recovery step, a first beach cleaner A is allowed to travel on a sandy beach while being towed by a self-traveling vehicle R, whereby waste G1 such as string-like waste and other elongated waste is caught on rakes and conveyed to a waste recovery area. In a waste recovery station the first beach cleaner A is lifted to recover the waste. In a second waste recovery step, while a second beach cleaner is allowed to travel by the self-traveling vehicle, waste such as cans which have not been recovered in the first waste recovery step are scooped up in a waste conveying section, and are then collected in a waste collecting section by means of scraping blades and are recovered in a waste recovering area. In a third waste recovery step, while the first beach cleaner A is allowed to travel at a high speed by the self-traveling vehicle R, small waste such as cigarette butts popped up with sand which is scraped up by the scraper are allowed to drop and collected onto a waste catch net, and the waste thus collected is recovered in the waste recovery area.

21 Claims, 10 Drawing Sheets

METHOD FOR RECOVERING WASTE IN SANDY BEACH

CROSS-REFERENCE TO RELATED APPLICATIONS

The present application claims priority under 35 USC 119 to Japanese Patent Application No. 2000-308494 filed on Oct. 6, 2000 the entire contents thereof is hereby incorporated by reference.

BACKGROUND OF THE INVENTION

1. Field of the Invention

The present invention relates to a method of using beach cleaners for recovering various waste scattered on a sandy beach such as a bathing beach.

2. Description of Background Art

Scattered waste such as fragments of fishing nets, vinyl strings, paper scraps, wood chips and blocks, empty cans, bottles, PET bottles and caps thereof, and cigarette butts are found on a sandy beach such as a bathing beach. If this waste remains on the beach, not only will the sand become more and more dirty, but also sea bathers may be accidentally injured. Thus, just before the sea bathing season there is a need for cleaning the beach for recovering waste from the sandy beach by means of a beach cleaner.

Heretofore, there has been known a method for recovering waste from a sandy beach by using a beach cleaner wherein the beach cleaner is allowed to make only a single round in a cleaning area of the sandy beach to complete the cleaning operation. The beach cleaner includes a self-traveling cleaner body and includes a cleaning means necessary for cleaning, including a scooping machine provided in a front portion of the cleaner body to scoop up waste present on and in sand together with sand, as well as means for separating waste and sand from each other during conveyance of the waste and sand rearwardly by a belt conveyor, and allowing the sand to drop onto the sandy beach. The device includes a way of recovering the waste into a basket or the like provided in a rear portion of the cleaner body. See, for example, Japanese Patent Laid-open No. Hei 3-138203.

However, according to the above conventional method for recovering waste from a sandy beach, since various large and small waste is present on and in sand of a sandy beach that are recovered together by a single self-traveling type beach cleaner, the load imposed on the recovery device is large, thus requiring the beach cleaner to travel at a low speed. This increases the cleaning time. This is not efficient. Besides, since the entire structure of the beach cleaner is complicated and of a large-size, the beach cleaner is heavy and the maintenance and servicing work is complicated and requires a long time. Further, the fabrication cost is high, and since the beach cleaner is low in working efficiency, the use of an expensive dedicated machine results in an increase in the maintenance cost.

The present invention has been accomplished in view of the above-mentioned circumstances and it is an object of the invention to provide a method for recovering waste on a sandy beach which method permits various waste scattered on a sandy beach to be recovered efficiently so as to clean the sandy beach with use of a beach cleaner of a simple structure.

SUMMARY AND OBJECTS OF THE INVENTION

For solving the above-mentioned problems the present invention provides a method for recovering waste on a sandy beach that includes a first waste recovery step for causing a first beach cleaner to travel in a cleaning area of a sandy beach while towing the beach cleaner by a self-traveling vehicle. The first beach cleaner includes a frame and a plurality of pins projecting downwardly from a lower surface of the frame. The frame is formed in a hurdle shape in plane view and a sled shape in side view, allowing waste present in the cleaning area to be caught on the pins, conveying the waste to a waste recovery area, and recovering the waste. A second waste recovery step is provided for causing a second beach cleaner to travel in the cleaning area having gone through the first waste recovery step while towing it by the self-traveling vehicle. The second beach cleaner includes a hurdle-like waste recovering section in a front portion of a frame and a waste collecting section in a rear portion of the frame. The waste conveying section is inclined so that a front end thereof comes into contact with sand and a rear portion thereof is higher, allowing waste to be scooped up by the waste conveying section and captured in the waste collecting section, causing the second beach cleaner to move to the waste recovery place, and recovering the captured waste. A third waste recovery step is provided for causing the first beach cleaner or a third beach cleaner to travel in the cleaning area having gone through the second waste recovery step while towing the beach cleaner by the self-traveling vehicle at a higher speed than in the first waste recovery step. The third cleaner is fabricated by attaching a scraper to the lower surface of the frame of the first beach cleaner, allowing waste to be scraped up by the pins and/or the scraper and caught in a waste catch net stretched on the frame of the beach cleaner, conveying the waste thus caught in the waste catch net to the waste recovery place, and recovering the waste.

According to this construction, in the first waste recovery step, the first beach cleaner is allowed to travel while being towed by a self-traveling vehicle. The sand is scraped and softened by the pins which are inserted deep into sand of the sandy beach, and at the same time elongated waste such as strings and driftwoods, as well as such waste such as stones, are caught on the pins and conveyed to the waste recovery place. Thereafter, then the first beach cleaner is lifted in a waste recovery station, allowing the waste to drop onto sand from the pins wherein waste is then recovered.

In the second waste recovery step, the second beach cleaner is allowed to travel while being towed by the self-traveling vehicle, whereby waste such as cans, bottles, PET bottles, caps thereof, and wood chips and blocks, which have not been recovered in the first waste recovery step, are scooped up together with sand in the waste conveying section of the second beach cleaner and are captured in the waste collecting section while being separated from sand. Thereafter, in the waste recovery area the captured waste is recovered from the waste collecting section.

Further, in the third waste recovery step, the first beach cleaner or the third beach cleaner fabricated by attaching a scraper to the lower surface of the frame of the first beach cleaner is allowed to travel at a higher speed than in the first waste recovery step. With this higher speed of travel, sand is scooped up and lifted by the pins of the first beach cleaner or by both pins and scraper of the third beach cleaner, whereby cigarette butts and other small waste mixed in the sand are popped up and drop onto a catch net stretched on the frame. The waste thus collected is recovered from the catch net in the waste recovery place.

According to this waste recovering method for a sandy beach, since the functions of two types of beach cleaners are used properly and waste is recovered stepwise through three waste recovery steps, waste is recovered successively and appropriately according to the types and sizes of waste scattered on and in the sandy beach. In addition, the waste recovering work can be done quickly and therefore the efficiency thereof is improved.

According to the present invention, there is provided in combination a method for recovering waste from a sandy beach wherein, in the third waste recovery step, the length of the downwardly projecting pins from the frame of the first beach cleaner, as well the number of the pins, are adjusted to be shorter and smaller than the pins in the first waste recovery step.

According to this construction, since the depth of the pins inserted into the sand of the sandy beach is shallow, the running resistance of the first beach cleaner induced by sand becomes smaller, so that the first beach cleaner can be allowed to travel at a high speed.

According to the present invention there is provided a waste recovering method wherein in at least one of the first, second and third waste recovery steps the beach cleaner that is used is allowed to reciprocate in one of a longitudinal or transverse direction in the cleaning area and, after the end of waste recovery, is allowed to reciprocate in the other direction to recover waste.

According to this construction, traveling grooves formed on sand by the travel of the beach cleaner in one direction are filled up and leveled with the travel of the beach cleaner in the other direction. Further, the recovery of waste can be completed in a more satisfactory manner.

According to the present invention, there is provided a waste recovering method wherein in the first waste recovery step the first beach cleaner which has moved to the waste recovery place is lifted by a waste recovery station installed in the waste recovery place so that the pins of the first beach cleaner are spaced a predetermined height from the sand.

According to this construction, since the first beach cleaner which has been moved to the waste recovery place is lifted by the waste recovery station and string-like waste caught on the pins easily drops onto the sand, it is not necessary to lift the first beach cleaner by a manual operation in the waste recovery place and thus the recovery of waste can be completed in a simple and quick manner without requiring manual labor.

A method for recovering waste from a sandy beach according to an embodiment of the present invention will be described hereinunder with reference to the accompanying drawings.

The method for recovering waste on a sandy beach embodying the present invention comprises a first waste recovery step of allowing a first beach cleaner A to travel in a cleaning area S of the sandy beach while towing the beach cleaner by a self-traveling vehicle R, allowing waste present in the cleaning area S to be caught on pins (rakes) 4, conveying the waste to a waste recovery area E and recovering the waste. A second waste recovery step of allowing a second beach cleaner B to travel in the cleaning area S cleaned by the first waste recovery step while towing the beach cleaner by the self-traveling vehicle R, scooping up waste in a waste conveying section 15, collecting the waste in a waste collecting section 16, moving the second beach cleaner to a waste recovery area E, and recovering the waste. A third waste recovery step of allowing the first beach cleaner A, or a third beach cleaner A1 fabricated by attaching a scraper to the frame of the first beach cleaner, to travel in the cleaning area S having been cleaned by the second waste recovery step while towing the beach cleaner by the self-traveling vehicle R at a higher speed than in the first waste recovery step, conveying waste scraped by the pins and/or the scraper and caught on a waste catch net 8 up to the waste recovery area E, and recovering the waste.

In the first waste recovery step, the first beach cleaner A is lifted by the waste recovery station C as necessary in the waste recovery area E.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

A description will first be given about the first, second, third beach cleaners A, B, A1 and the waste recovery station C which are used in the above waste recovery steps.

Figure 1:
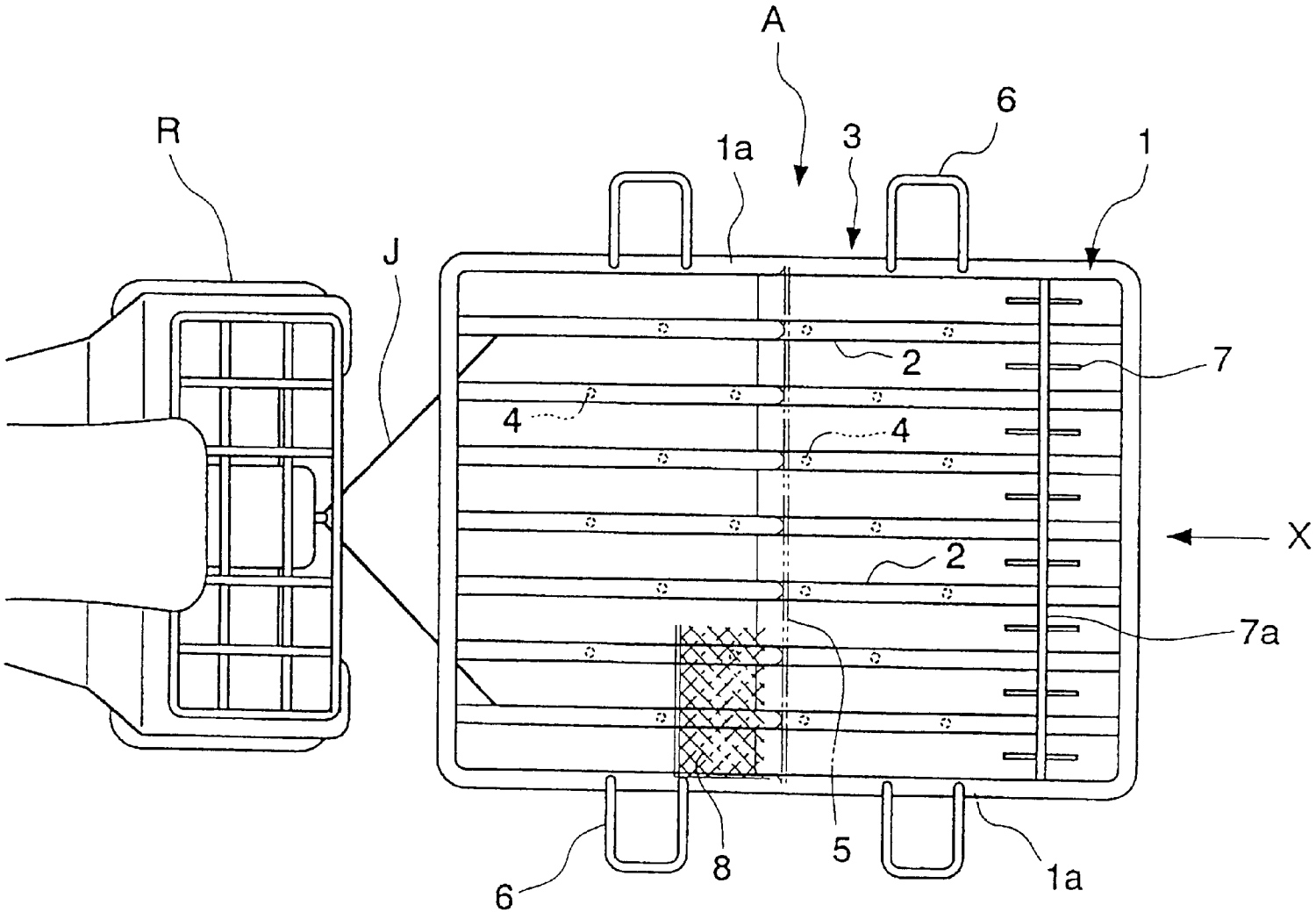
FIG. 1 is a plan view of a first beach cleaner used in carrying out the method for recovering waste from a sandy beach according to an embodiment of the present invention.
Figure 2:
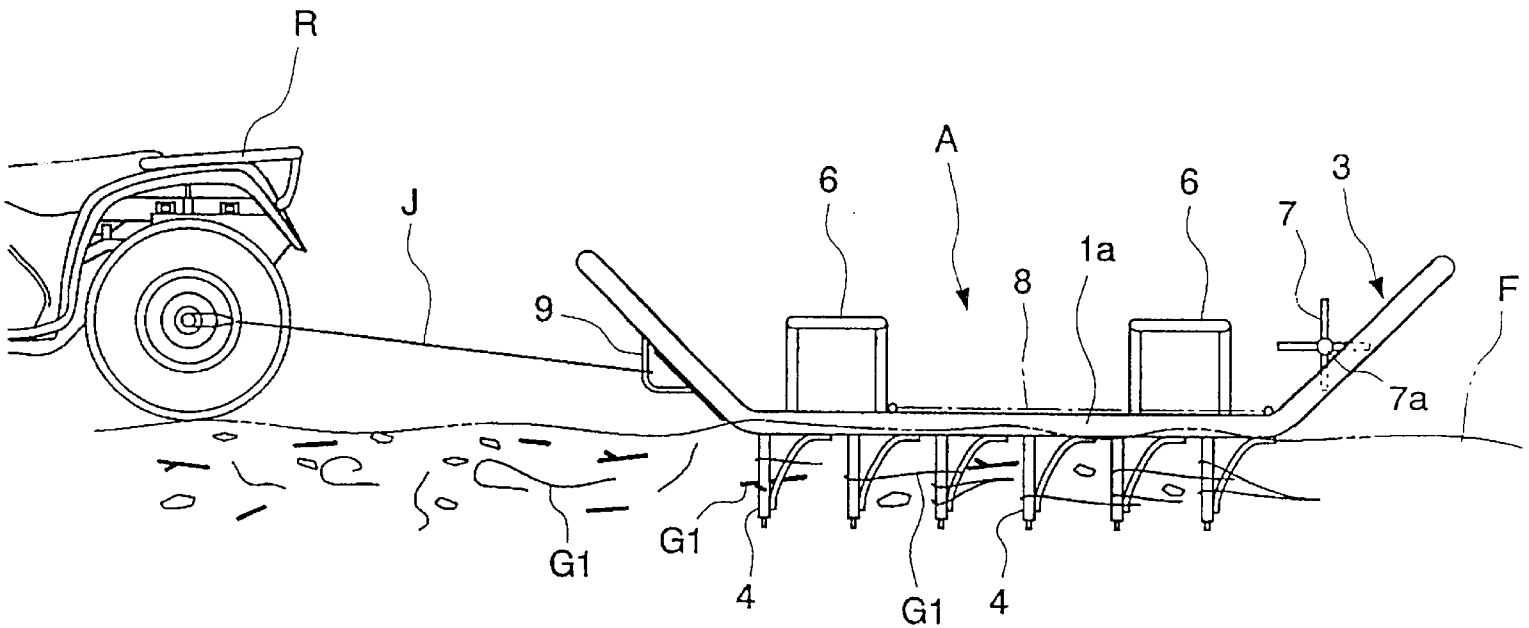
FIG. 2 is a side view thereof.
Figure 3:
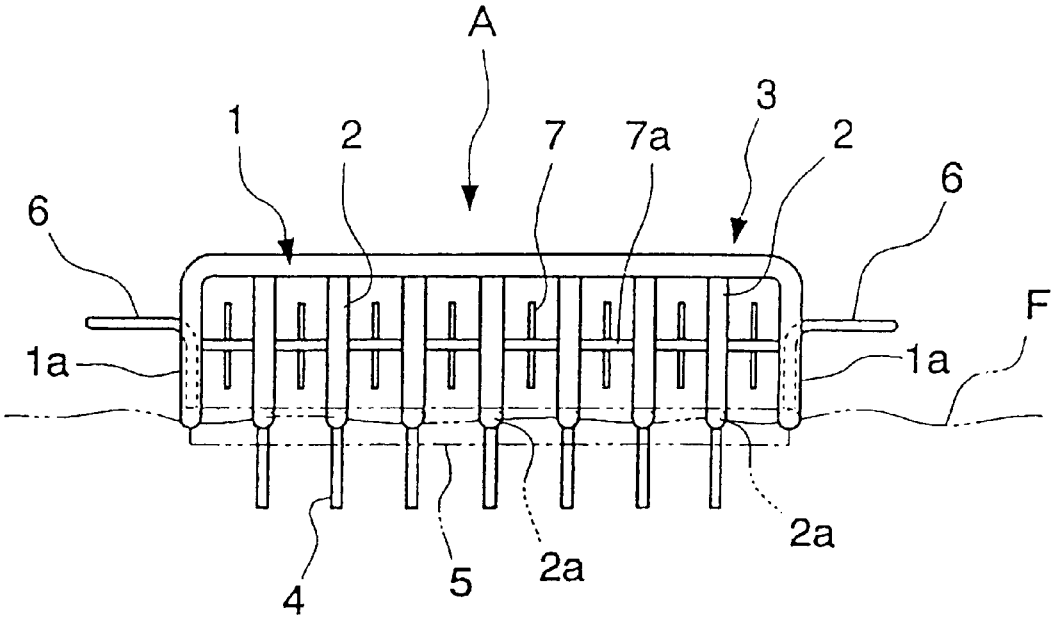
FIG. 3 is a view as seen in the direction of arrow X in FIG. 1.

As illustrated in FIGS. 1 to 3, the first beach cleaner A includes a frame 3 wherein a plurality of longitudinally extending longitudinal members 2 are fixed inside an outer frame 1 so as to be suitably spaced from one another. The shape of the outer frame 1 is substantially a rectangular shape in plan, and is inclined in a sled shape so that front and rear sides thereof are higher toward the respective . A plurality of pins or rakes 4 are fixed to lower surfaces of the longitudinal members 2 substantially throughout the whole of the horizontal portions 2*a* of the longitudinal members in a suitable spaced relationship longitudinally, with the longitudinal phases being displaced by adjacent longitudinal members 2, providing a zigzag arrangement in plan. A pair of front engaging members 6 and a pair of rear engaging members 6, both engaging members 6 project outwardly from longitudinal members 1*a* of the outer frame 1. A rotor 7 is fixed onto a rotary shaft 7*a* on a rear end side of the frame 3 and includes a plurality of blades adapted to rotate between adjacent longitudinal members 2.

The length of the downward projection of each pin 4 can be adjusted appropriately. Retaining means 9 for anchoring rope members J such a chain or wire connected to a saddle-ride type four-wheeled vehicle as the self-traveling vehicle R are fixed to front positions of a pair of longitudinal members 2 located near both transverse sides. The spacing between adjacent longitudinal members 2 is set to a size which permits passage therethrough of an empty can. Further, a waste catch net 8 may be removably stretched on an upper surface of the frame 3.

Figure 9:
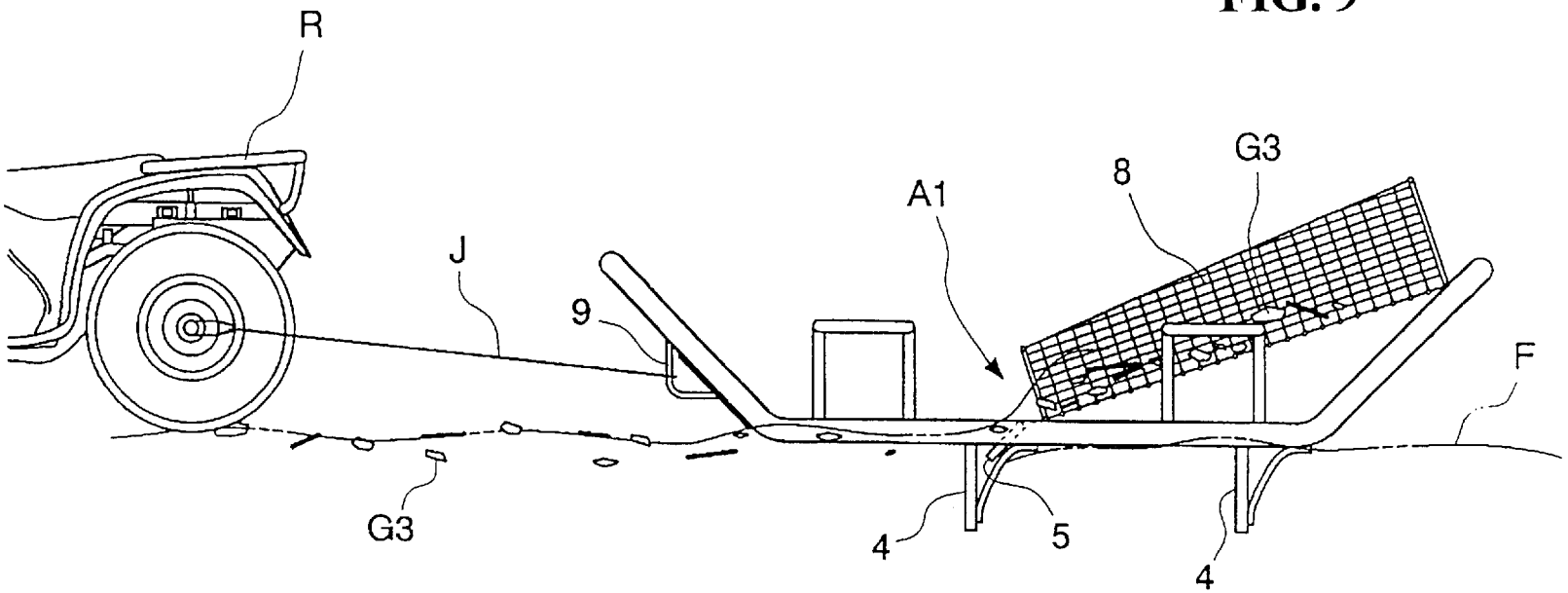
FIG. 9 is a diagram explanatory of a third waste recovery step using a third beach cleaner.

As a substitute for the first beach cleaner A there also is provided the third beach cleaner A1. In the third beach cleaner, as shown in FIG. 9, the rotor 7 used in the first beach cleaner A is omitted. The pins 4 used in the third beach cleaner include only one transverse line of pins located centrally in the longitudinal direction of the horizontal portions 2*a*, or only a central and a rear end line of pins. The other pins used in the first embodiment are omitted to reduce the number of pins used. Further, as to the scraper 5 (see also chain lines in FIGS. 1 and 3) positioned behind the central (front-side) pins 4 and inclined downwardly on the front side thereof, the scraper 5 is attached perpendicularly to both-side longitudinal frame members 1*a* of the outer frame 1 in the frame 3 and the longitudinal members 2. A waste catch net 8 is mounted removably on the upper surface of the frame 3 so as to stretch from just behind the scraper 5 towards a rear portion of the frame 3. In this case, the pins 4 are arranged like a straight line without longitudinal phase displacement between adjacent longitudinal members 2.

The "longitudinal" and "transverse" directions as referred to herein indicate front and rear in the traveling direction of the beach cleaners A, B, A1 and directions perpendicular to the traveling direction, respectively.

Figure 4:
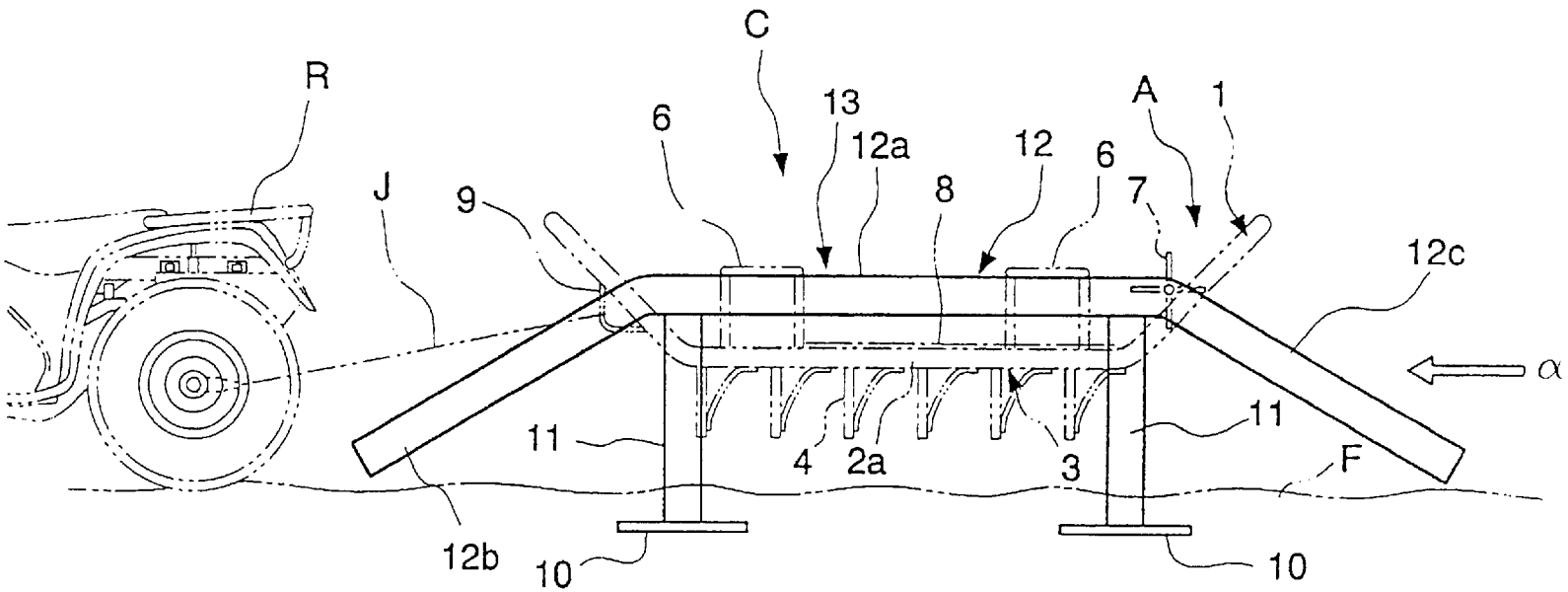
FIG. 4 is a side view of a waste recovery station.
Figure 5:
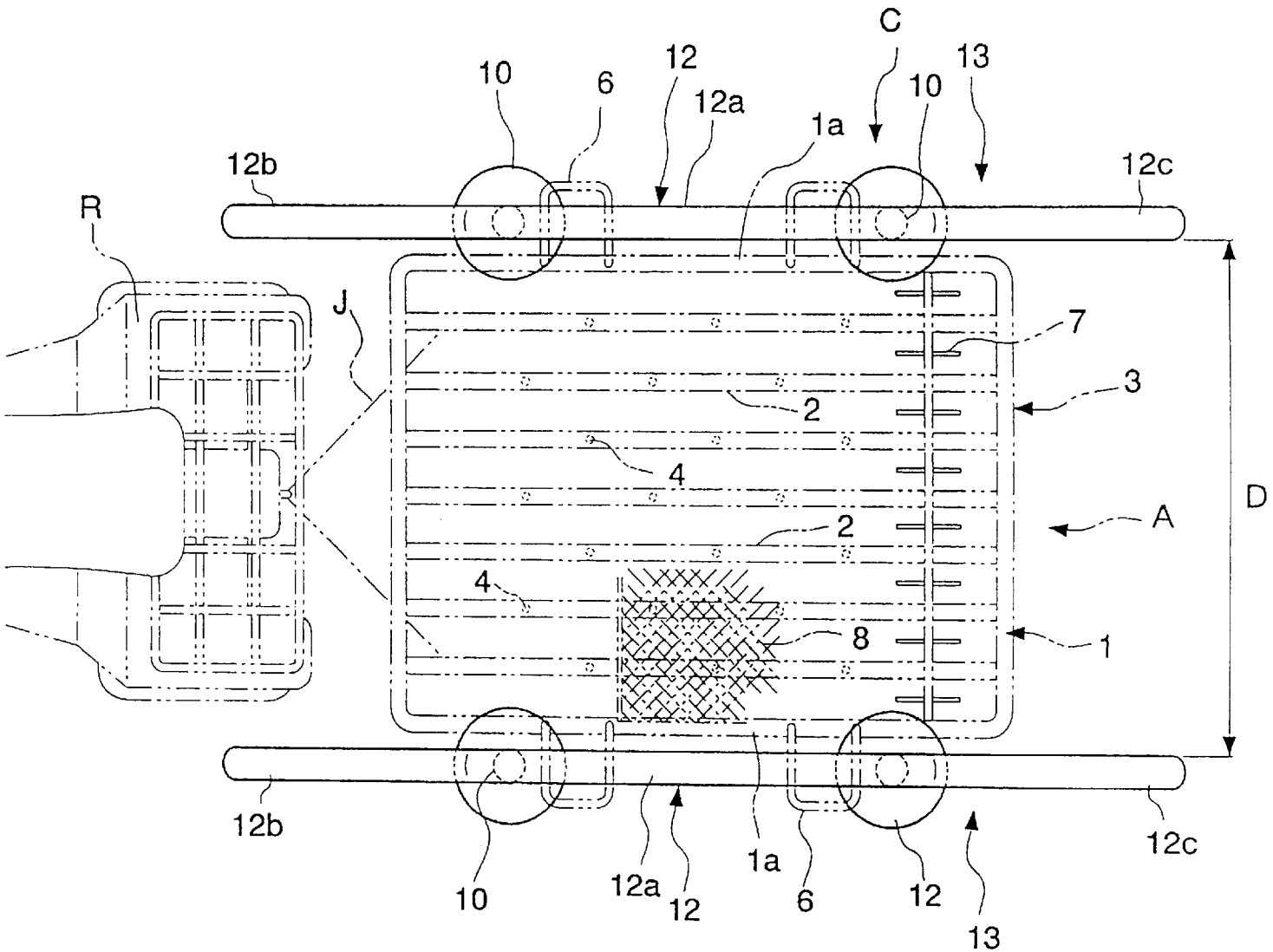
FIG. 5 is a plan view thereof.
Figure 6:
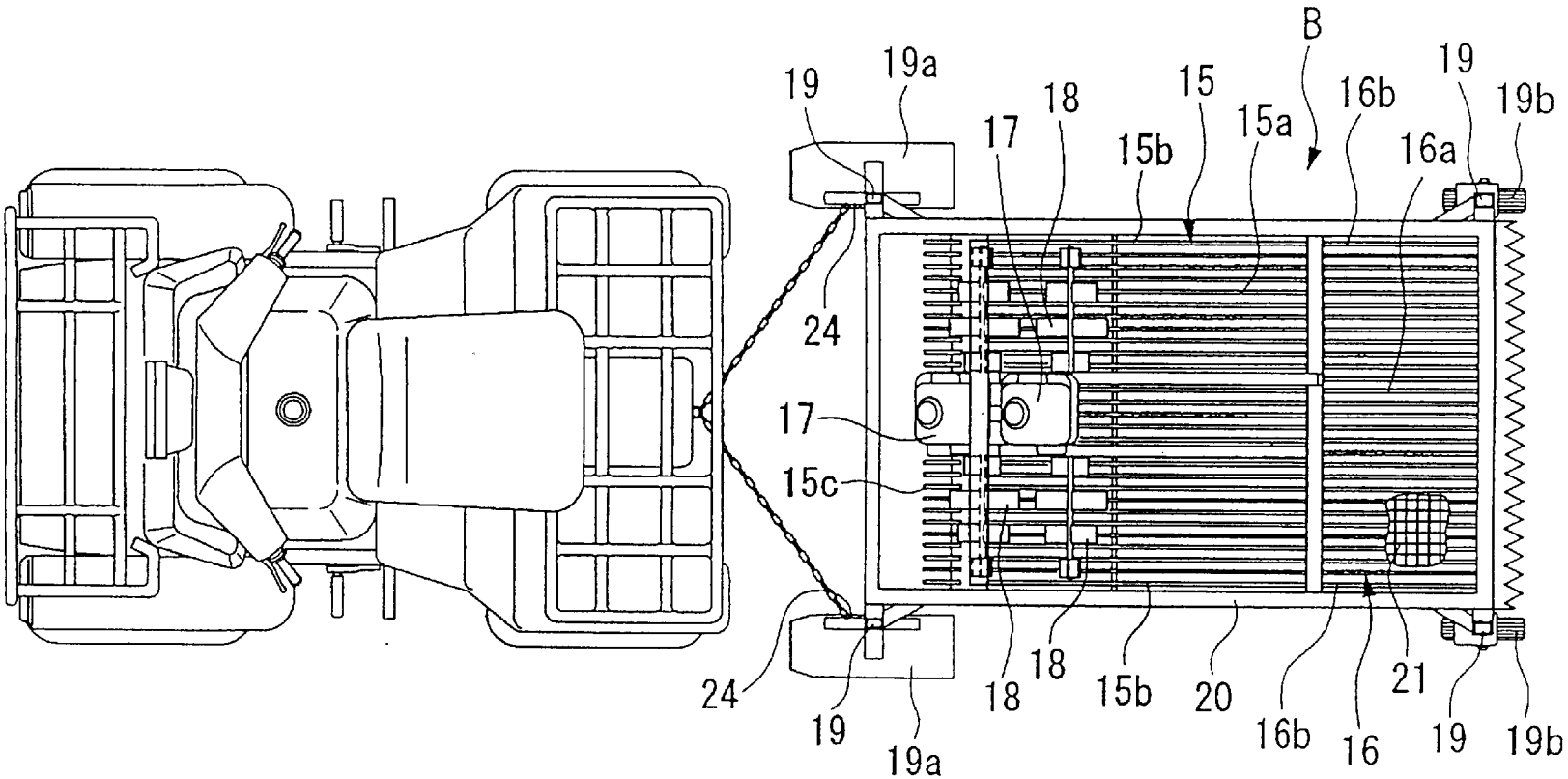
FIG. 6 is a plan view of a second beach cleaner used in carrying out the method of the embodiment.

A waste recovery station C is constructed as illustrated in FIGS. 4 and 5. As shown in FIGS. 4 and 5, the waste recovery station C has a pair of station members 13. The pair of stations members 13 each comprise a pair of support posts 11, with a foot 10 being fixed to a lower end of each support post 11, the foot 10 being constituted by a circular or square flat plate for example. Guide members 12 are fixed, respectively, to upper ends of the support posts 11. The paired station members 13 are installed so that the guide members 12 are positioned in parallel with each other and so that the support posts 11 stand upright on or in sand through the foot 10 in the waste recovery area E.

Longitudinally intermediate portions of the guide members 12 are formed as horizontal portions 12*a*, respectively, and front and rear end sides thereof are bent downwardly at an obtuse angle to form slant portions 12*b* and 12*c*. The spacing D between the guide members 12 is set to a value larger than the width of the frame 3 of the first beach cleaner A (A1) and the width of the traction vehicle R. The spacing D permits the guide members to engage the engaging members 6. The horizontal portions 12*a* of the guide members 12 are set at a height at which the pins 4 of the beach cleaner A (A1) are spaced sufficiently from an upper surface F of sand when the beach cleaner is positioned onto the horizontal portions 12*a*.

The second beach cleaner B is constructed as follows. A waste conveying section 15 is inclined so that a front side thereof is lower, with pawls 15*c* being formed at a front end thereof. A waste collecting section 16 is positioned behind the waste conveying section 15, and two front and rear rows of rotors or scraping blades 18 are disposed above the waste conveying section 18 and are adapted to rotate with power or an engine 17. A frame 20, which is rectangular in plan and whose four comers are grounded through leg posts 19 having grounding portions 19*a* and 19*b*, supports the waste collecting device.

The waste conveying section 15 and the waste collecting section 16 are formed in a box shape having front and upper sides that are open by a hurdle-like member. The hurdle-like member is formed by arranging a plurality of rods in bottoms 15*a*, 16*a* and both side walls 15*b*, 16*b* of both sections in the longitudinal direction so as to be spaced suitably from one another (about 20 mm). The bottoms 15*a* and 16*a* are spaced a predetermined height from the upper surface F of the sand. The waste collecting section 16 is formed by stretching a net 21 along the outside of the hurdle-like member. Behind the waste collecting section 16 is formed a rear wall 23 by a hurdle-like member which is provided at a lower end thereof with an elastic member 22 such as a rubber plate for leveling the upper surface of sand. The hurdle-like member of the rear wall 23 is formed by arranging rods in the vertical direction so as to be spaced about 20 mm from one another. This spacing is the same as above.

The pawls 15*c* are formed by rods connected to front ends of the constituent rods of the hurdle-like member in the waste conveying section 15 so as to be inclined at a larger angle downwardly than the the constituent rods.

In the leg posts 19, the front grounding portions 19*a* are formed by ski-like members, while the rear grounding portions 19*b* are formed by casters, both being vertically adjustable in plural stages. Retaining means 24, such as hooks for retaining the rope members J such as a chain or wire, are connected to the self-traveling vehicle R and are fixed to both front grounding portions 19*a*.

The following will describe a method for recovering waste scattered on a sandy beach, using the beach cleaners A, B, A1 and the waste recovery station C constructed as above.

Figure 10:
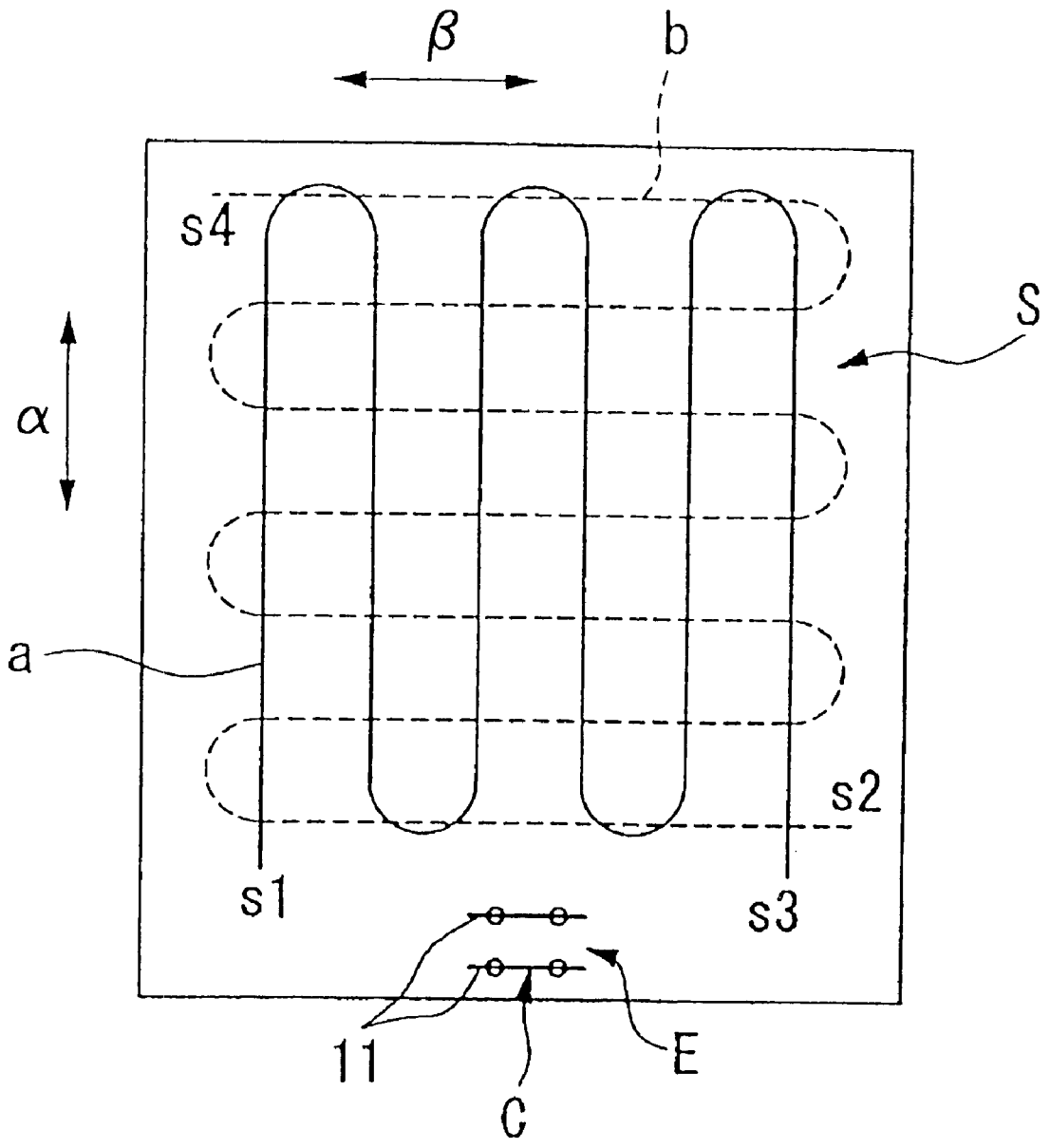
FIG. 10 is a diagram explanatory of beach cleaner traveling paths in a cleaning area of a sandy beach.

In cleaning a sandy beach, first as shown in FIG. 10, the waste recovery station C is installed in a suitable waste recovery area E in a cleaning area S of the sandy beach by setting the spacing between the pair of station members 13 at a value corresponding to the width of the first beach cleaner A.

Then, the first beach cleaner A is connected to the self-traveling vehicle R through the rope members J and is towed up to a cleaning start point s1 in the cleaning area, then the recovery of waste from the sandy beach is started in accordance with the first waste recovery step.

In the first waste recovery step, the length of downward projection of the pins 4 in the first beach cleaner A is set large and the first beach cleaner A travels along a travel path in one of a longitudinal direction a and a transverse direction β orthogonal thereto. For example, the first beach cleaner A would travel along a travel path "a" in the longitudinal direction a, at a speed of 10 to 15 km/h while being towed by the self-traveling vehicle R. At this time, the pins 4 of the first beach cleaner A are inserted deep into sand of the sandy beach and the sand is scraped and softened by the pins 4. Further, waste buried in the sand is scraped up and waste G1 present on and in the sand such as elongated waste, e.g., string-like waste and driftwood, as well as stones, are caught on the pins 4 and are moved together with the first beach cleaner A. Upon arrival at a terminal end of the travel path "a", the first beach cleaner A is moved up to the waste recovery area E.

When the self-traveling vehicle R is passed at a low speed between the pair of station members 13 in the waste recovery station C, the first beach cleaner A is lifted from the sand upper surface F along the guide members 14, so the movement of the first beach cleaner is stopped when it is lifted in a horizontal state, see FIG. 4. During this period, the waste caught on the pins 4 drop onto the sand naturally. The dropped waste is suitably collected and recovered. If there is any waste entwined on the pins 4 that fails to drop naturally, such waste can be raked off easily using a suitable implement.

After the recovery of waste is completed by allowing the first beach cleaner A to travel on the travel path "a" in the longitudinal direction α, the first beach cleaner A is carried to a cleaning start point s2 in the transverse direction β, from where the first beach cleaner is allowed to travels along a travel path "b," as illustrated in broken lines, to recover waste in the same manner as above.

When the first beach cleaner A is thus allowed to travel in both longitudinal and transverse directions α, β, groove traces initially formed on the sand upper surface F by the pins 4 are filled up by the subsequent travel of the beach cleaner, so that the sand upper surface F is leveled.

When reciprocating along the travel paths "a" and "b" in the longitudinal and transverse directions α, β, the first beach cleaner A moves at a turn-back portion thereof sideways to the side where cleaning has not been completed. In this case, the distance, pitch, between forward and return paths is preferably set approximately equal to the width of the first beach cleaner A so that no uncleaned portion of the sandy beach remains.

After the first waste recovery step has thus been completed, the second waste recovery step is started using the second beach cleaner B.

Figure 7:
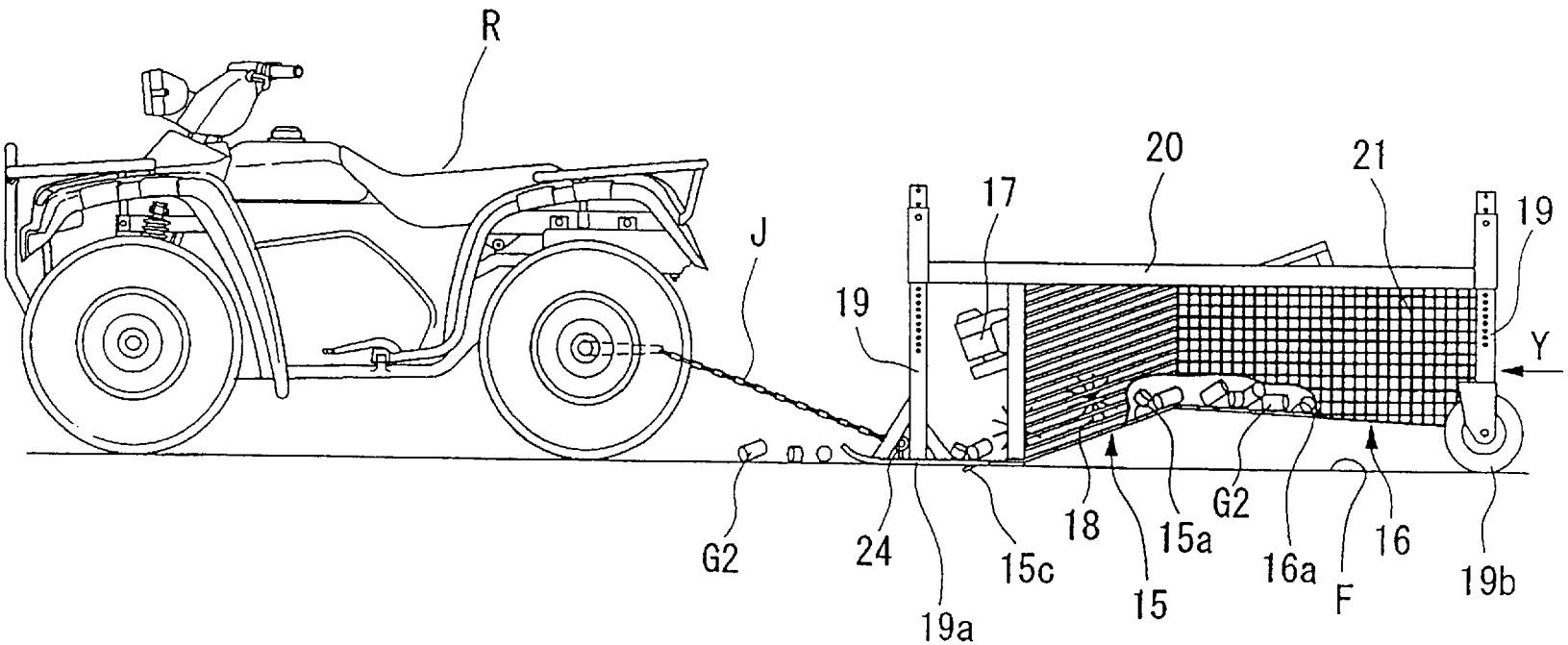
FIG. 7 is a side view thereof.
Figure 8:
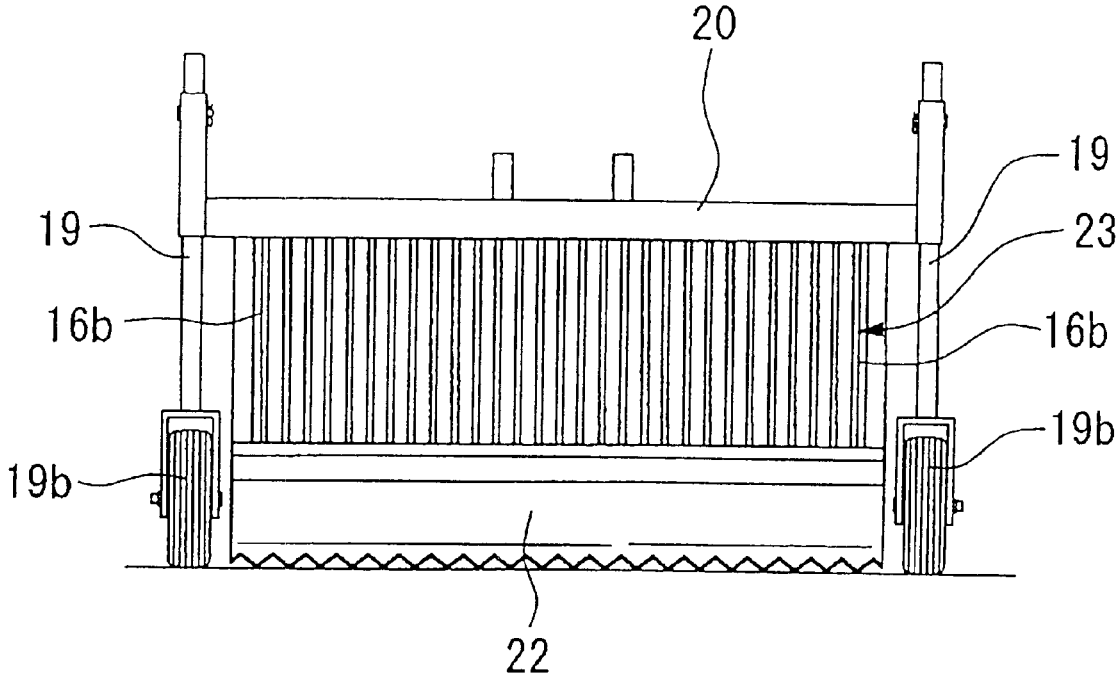
FIG. 8 is a view as seen in the direction of arrow Y in FIG. 7.

In the second waste recovery step, the second beach cleaner B is moved to a cleaning start point s3, from where the second beach cleaner is allowed to travel along the travel path "a" in the longitudinal direction a while being towed by the self-traveling vehicle R. At this time, the pawls 15*c* formed in the front part of the waste conveying section 15 in the second beach cleaner B project into the sand and scrape up waste G2 such as cans, bottles, PET bottles, pebbles, and wood chips and blocks which are left unrecovered in the first waste recovery step, together with sand, causing the waste and sand to move onto the bottom 15*a* of the waste conveying section 15. The waste thus moved onto the bottom 15*a* is separated, while being conveyed rearwardly by the rotors 18, from the sand which drop from gaps in the hurdle-like member of the bottom 15*a*. The waste is collected in the waste collecting section 16, see FIG. 7.

When the second beach cleaner B has traveled up to the terminal end of the travel path "a" in the longitudinal direction α, it is moved to the waste recovery area E, where the collected waste is recovered from the waste collecting section. After traveling on the longitudinal travel path "a" in the longitudinal direction α and after the completion of waste recovery, the second beach cleaner B is moved to a cleaning start point s4 in the transverse direction β, from where it is reciprocated the travel path "b" to recover waste in the same way as above.

After the second waste recovery step is over in the manner described above, the third waste recovery step is started using the first beach cleaner A or the third beach cleaner A1.

In the third waste recovery step, the length of downward projection of the pins 4 of the first beach cleaner A is adjusted shorter than in the first waste recovery step. With the waste catch net 8 stretched on the frame 3, the first beach cleaner A is towed at a higher speed of 30 to 35 km/h, as compared to the first waste recovery step, by the self-traveling vehicle R and is allowed to travel on the travel paths "a" and "b" in the longitudinal and transverse directions α and β in the same manner as in the first waste recovery step. The third beach cleaner A1 may be used instead of the first beach cleaner A and may be allowed to travel in the same manner as the first beach cleaner A, provided the length thereof is adjusted to the same length as the first beach cleaner A.

With this high-speed travel, sand is scraped up by the pins 4 in the case of the first beach cleaner A or by both pins 4 and scraper 5 in the case of the third beach cleaner A1. Waste G3 such as cigarette butts, bottles, PET bottles, caps of the bottles, and other small waste, which are popped up as the sand is scraped up, drop onto the waste catch net 8 on the frame 3 and are collected. The waste is recovered from the waste catch net 8 in the waste recovery area E, see FIG. 9. Also in the third waste recovery step, if waste is caught on the pins 4 of the first beach cleaner A or the third beach cleaner A1, either beach cleaner A or A1 may be lifted in the waste recovery station C as in the first waste recovery step.

According to this method for recovering waste on a sandy beach, since the recovery of waste in the cleaning area S of the sandy beach is executed stepwise by the first, second and third waste recovery steps while making the most of the respective functions of the first, second and third beach cleaners A, B and A1, not only waste scattered on the sandy beach are successively recovered properly according to types and sizes of the waste, but also the waste recovering work can be done quickly and the working efficiency thereof is improved.

Besides, since each of the beach cleaners A, B, and A1 is simple in its entire mechanism and is small-sized, there occurs little failure and maintenance and servicing are easy. Moreover, the traveling vehicle R is not integral with the beach cleaner, so during the period when the beach cleaners A, B, and A1 are not in use, the traveling vehicle R is utilized for another purpose. Consequently, the working efficiency is improved as a whole and the maintenance cost is low.

In the above embodiment, in each of the waste recovery steps, the first, second, or third beach cleaner A, B, or A1 is moved to the waste recovery area E to recover the waste collected thereon after reaching the terminal end of the travel path "a" or "b" in the longitudinal and transverse directions α, β, this constitutes no limitation. Halfway along the travel paths "a" and "b" the beach cleaner concerned may be moved to the waste recovery area E at an appropriate time according to the amount of waste collected and thereafter may be allowed to travel on the remaining portion of the travel path.

Further, although the waste recovery steps are each carried out once to complete the recovery of waste, each of the waste recovery steps may be carried out a plurality of times, as necessary, or only a specific waste recovery step may be carried out a plurality of times. Thus, no special limitation is placed on how many times each waste recovery step is to be executed.

Further, since in each of the waste recovery steps the first, second and third beach cleaners A, B and A1 are allowed to travel on both travel paths "a" and "b" in the longitudinal direction α and in the transverse direction β orthogonal thereto, traveling grooves formed by the travel path of each beach cleaner in one direction are filled up to be level with the sandy beach as the beach cleaner travels in the other direction. This is preferable because the upper surface F of sand in the sandy beach is leveled clean. However, the travel path directions are not limited to the above. The travel path may be in other directions or even only in one direction will do.

Further, although in the above embodiment the three, first to third waste recovery steps are carried out in order, no limitation is made thereto. One or more waste recovery steps may be selected and executed as necessary, provided it is preferable that the third waste recovery step is executed last. Also in this case it is possible to carry out a selective high-efficiency work incapable of being carried out by a conventional large-sized machine which is constituted by an integral combination of a waste recovery apparatus and a self-traveling vehicle.

As set forth above, the following outstanding effects are attained by the present invention.

According to the method for recovering waste on a sandy beach according to the present invention, since three waste recovery steps are carried out stepwise while properly using the functions of two types of beach cleaners, not only is it possible for waste scattered on a sandy beach to be successfully recovered appropriately according to the type and size of the waste, but also the waste recovering work can be carried out quickly and the working efficiency thereof can be improved.

Besides, since each beach cleaner is simple in its entire mechanism and is a small-sized, a small number of failures occur and maintenance and servicing can be done easily. Additionally, the traveling vehicle is not integral with each beach cleaner, so during the period when the beach cleaners are not in use, the traveling vehicle can be utilized for another purpose, thus permitting improvement of the working efficiency as a whole and reduction of the maintenance cost.

According to the method for recovering waste from a sandy beach according to the present invention, the depth of the rakes inserted into the sand of the sandy beach is shallow, thereby diminishing the moving resistance of the first beach cleaner induced by sand and permitting the first beach cleaner to travel at a high speed, so that the waste recovering work can be done in a high efficiency manner.

According to the method for recovering waste from a sandy beach according to the present invention, traveling grooves formed in the sand by movement of the beach cleaner in one direction can be filled up and leveled by movement of the beach cleaner in the other direction and the recovery of waste can be preformed in a more satisfactory manner.

According to the method for recovering waste from a sandy beach according to the present invention, the first beach cleaner which has been moved to the waste recovery area is lifted by the waste recovery station and waste such as string-like waste caught on the rakes is allowed to easily drop onto sand. Thus, it is not necessary to lift the first beach cleaner by a manual operation in the waste recovery area, that is, the recovery of waste can be preformed in a simple and quick manner without requiring manual labor.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A method for recovering waste from a sandy beach, comprising:

causing a first beach cleaner to travel in a cleaning area of a sandy beach while towing the first beach cleaner by a self-traveling vehicle, said first beach cleaner having a frame and a plurality of pins projecting downwardly from a lower surface of said frame, said frame being formed in a hurdle-shape in plan view and a sled-shape in side view, allowing waste present in said cleaning area to be caught on said pins, conveying the waste to a waste recovery area, and recovering the waste;

causing a second beach cleaner to travel in the cleaning area cleaned by the first waste recovery step while towing the second beach cleaner by the self-traveling vehicle, said second beach cleaner having a hurdle-like waste conveying section in a front portion of a frame and a waste collecting section in a rear portion of the frame, said waste conveying section being inclined so that a front end thereof comes into contact with sand and a rear portion thereof is higher, allowing waste to be scooped up by said waste conveying section and captured in said waste collecting section, causing the second beach cleaner to move to the waste recovery area, and recovering the captured waste; and causing said first beach cleaner to again travel in the cleaning area cleaned by the second waste recovery step while towing the first beach cleaner by the self-traveling vehicle at a higher speed relative to the first waste recovery step.

2. The method for recovering waste from a sandy beach according to claim 1, wherein in said third waste recovery step the length of downward projection of the pins from the frame of the first beach cleaner, as well as the number of the pins, are adjusted shorter and smaller relative to the pins of said first waste recovery step.

3. The method for recovering waste from a sandy beach according to claim 1, wherein in at least one of said first, second and third waste recovery steps the beach cleaner used therein is allowed to reciprocate in one of longitudinal and transverse directions in said cleaning area and, after the end of waste recovery, is allowed to reciprocate in the other direction to recover waste.

4. The method for recovering waste from a sandy beach according to claim 2, wherein in at least one of said first, second and third waste recovery steps the beach cleaner used therein is allowed to reciprocate in one of longitudinal and transverse directions in said cleaning area and, after the end of waste recovery, is allowed to reciprocate in the other direction to recover waste.

5. The method for recovering waste from a sandy beach according to claim 1, wherein in said first waste recovery step the first beach cleaner which has moved to said waste recovery area is lifted by a waste recovery station installed in the waste recovery area so that the pins of the first beach cleaner are spaced a predetermined height from sand.

6. The method for recovering waste from a sandy beach according to claim 2, wherein in said first waste recovery step the first beach cleaner which has moved to said waste recovery area is lifted by a waste recovery station installed in the waste recovery area so that the pins of the first beach cleaner are spaced a predetermined height from sand.

7. The method for recovering waste from a sandy beach according to claim 3, wherein in said first waste recovery step the first beach cleaner which has moved to said waste recovery area is lifted by a waste recovery station installed in the waste recovery area so that the pins of the first beach cleaner are spaced a predetermined height from sand.

8. A method for recovering waste from a sandy beach, comprising:

causing a first beach cleaner to travel in a cleaning area of a sandy beach while towing the first beach cleaner by a self-traveling vehicle, said first beach cleaner having a frame and a plurality of pins projecting downwardly from a lower surface of said frame, said frame being formed in a hurdle-shape in plan view and a sled-shape in side view, allowing waste present in said cleaning area to be caught on said pins, conveying the waste to a waste recovery area, and recovering the waste;

causing a second beach cleaner to travel in the cleaning area cleaned by the first waste recovery step while towing the second beach cleaner by the self-traveling vehicle, said second beach cleaner having a hurdle-like waste conveying section in a front portion of a frame and a waste collecting section in a rear portion of the frame, said waste conveying section being inclined so that a front end thereof comes into contact with sand and a rear portion thereof is higher, allowing waste to be scooped up by said waste conveying section and captured in said waste collecting section, causing the second beach cleaner to move to the waste recovery area, and recovering the captured waste; and causing a third beach cleaner to travel in the cleaning area cleaned by the second waste recovery step while towing the third beach cleaner by the self-traveling vehicle at a higher speed relative to the first waste recovery step, said third beach cleaner being fabricated by attaching a scraper to the lower surface of the frame of said first beach cleaner, allowing waste to be scraped up by at least one of said pins and said scraper and caught in a waste catch net stretched on the frame of the beach cleaner, conveying the waste thus caught in the waste catch net to the waste recovery area, and recovering the waste.

9. The method for recovering waste from a sandy beach according to claim 8, wherein in said third waste recovery step the length of downward projection of the pins from the frame of the first beach cleaner, as well as the number of the pins, are adjusted shorter and smaller relative to the pins of said first waste recovery step.

10. The method for recovering waste from a sandy beach according to claim 8, wherein in at least one of said first, second and third waste recovery steps the beach cleaner used therein is allowed to reciprocate in one of longitudinal and transverse directions in said cleaning area and, after the end of waste recovery, is allowed to reciprocate in the other direction to recover waste.

11. The method for recovering waste from a sandy beach according to claim 9, wherein in at least one of said first, second and third waste recovery steps the beach cleaner used therein is allowed to reciprocate in one of longitudinal and transverse directions in said cleaning area and, after the end of waste recovery, is allowed to reciprocate in the other direction to recover waste.

12. The method for recovering waste from a sandy beach according to claim 8, wherein in said first waste recovery step the first beach cleaner which has moved to said waste recovery area is lifted by a waste recovery station installed in the waste recovery area so that the pins of the first beach cleaner are spaced a predetermined height from sand.

13. The method for recovering waste from a sandy beach according to claim 9, wherein in said first waste recovery step the first beach cleaner which has moved to said waste recovery area is lifted by a waste recovery station installed in the waste recovery area so that the pins of the first beach cleaner are spaced a predetermined height from sand.

14. The method for recovering waste from a sandy beach according to claim 10, wherein in said first waste recovery step the first beach cleaner which has moved to said waste recovery area is lifted by a waste recovery station installed in the waste recovery area so that the pins of the first beach cleaner are spaced a predetermined height from sand.

15. A method for recovering waste from a sandy beach, comprising:

cleaning a predetermined area of a sandy beach by moving a first beach cleaner over said area;

engaging sand with a plurality of pins projecting downwardly from a lower surface of a frame of said first beach cleaner;

allowing waste present in said predetermined area to be caught on said pins;

conveying the waste to a waste recovery area;

recovering the waste;

cleaning the predetermined area, cleaned by the first waste recovery step, with a second beach cleaner;

moving a hurdle-like waste conveying section in a front portion of a frame of the second beach cleaner over the predetermined area for collecting waste in a rear portion of the frame, said waste conveying section being inclined so that a front end thereof comes into contact with sand and a rear portion thereof is higher;

allowing waste to be scooped up by said waste conveying section and captured in a waste collecting section; and cleaning the predetermined area a third time with a third beach cleaner moved at a higher speed relative to the first waste recovery step;

attaching a scraper to a lower surface of a frame of said third beach cleaner;

allowing waste to be scraped up by at least one of pins and said scraper and caught in a waste catch net stretched on the frame of the third beach cleaner;

conveying the waste thus caught in the waste catch net to the waste recovery area; and recovering the waste.

16. The method for recovering waste from a sandy beach according to claim 15, wherein in said third waste recovery step the length of downward projection of the pins from the frame of the first beach cleaner, as well as the number of the pins, are adjusted shorter and smaller relative to the pins of said first waste recovery step.

17. The method for recovering waste from a sandy beach according to claim 15, wherein in at least one of said first, second and third waste recovery steps the beach cleaner used therein is allowed to reciprocate in one of longitudinal and transverse directions in said cleaning area and, after the end of waste recovery, is allowed to reciprocate in the other direction to recover waste.

18. The method for recovering waste from a sandy beach according to claim 16, wherein in at least one of said first, second and third waste recovery steps the beach cleaner used therein is allowed to reciprocate in one of longitudinal and transverse directions in said cleaning area and, after the end of waste recovery, is allowed to reciprocate in the other direction to recover waste.

19. The method for recovering waste from a sandy beach according to claim 15, wherein in said first waste recovery step the first beach cleaner which has moved to said waste recovery area is lifted by a waste recovery station installed in the waste recovery area so that the pins of the first beach cleaner are spaced a predetermined height from sand.

20. The method for recovering waste from a sandy beach according to claim 16, wherein in said first waste recovery step the first beach cleaner which has moved to said waste recovery area is lifted by a waste recovery station installed in the waste recovery area so that the pins of the first beach cleaner are spaced a predetermined height from sand.

21. The method for recovering waste from a sandy beach according to claim 17, wherein in said first waste recovery step the first beach cleaner which has moved to said waste recovery area is lifted by a waste recovery station installed in the waste recovery area so that the pins of the first beach cleaner are spaced a predetermined height from sand.

* * * * *